US007876280B2

(12) United States Patent
Black, Jr. et al.

(10) Patent No.: US 7,876,280 B2
(45) **Date of Patent: *Jan. 25, 2011**

(54) FREQUENCY CONTROL OF ELECTRICAL LENGTH FOR BICONE ANTENNAS

(75) Inventors: Donald N. Black, Jr., Cumming, GA (US); John D. Voss, Cumming, GA (US); Terence D. Newbury, Hoschton, GA (US); Michael G. Guler, Dawsonville, GA (US)

(73) Assignee: EMS Technologies, Inc., Norcross, GA (US)

( * ) Notice: Subject to any disclaimer, the term of this patent is extended or adjusted under 35 U.S.C. 154(b) by 3 days.

This patent is subject to a terminal disclaimer.

(21) Appl. No.: 12/012,880

(22) Filed: Feb. 6, 2008

(65) Prior Publication Data

US 2008/0186244 A1 Aug. 7, 2008

Related U.S. Application Data

(60) Provisional application No. 60/899,806, filed on Feb. 6, 2007, provisional application No. 60/899,813, filed on Feb. 6, 2007.

(51) Int. Cl.
*H01Q 13/00* (2006.01)
*H01Q 9/28* (2006.01)

(52) U.S. Cl. ..... 343/773; 343/807

(58) Field of Classification Search ..... 343/773
See application file for complete search history.

(56) References Cited

U.S. PATENT DOCUMENTS

| | | | | |
|---|---|---|---|---|
| 3,829,863 | A * | 8/1974 | Lipsky | 343/773 |
| 5,760,750 | A * | 6/1998 | Guertin | 343/807 |
| 7,339,529 | B2 * | 3/2008 | Martek | 343/700 MS |
| 2005/0093756 | A1 * | 5/2005 | Martek | 343/773 |
| 2006/0022885 | A1 * | 2/2006 | Ida et al. | 343/773 |
| 2007/0205951 | A1 * | 9/2007 | Black et al. | 343/773 |

* cited by examiner

*Primary Examiner*—Vibol Tan
*Assistant Examiner*—Dylan White
(74) *Attorney, Agent, or Firm*—King & Spalding LLP

(57) ABSTRACT

A broadband bicone antenna supports frequency selective control of electrical length. Frequency selective control of the electrical length of an antenna can provide an antenna exhibiting two or more different electrical lengths where use of each length depends upon the operating frequencies of the signals. The electrical length of the bicone antenna may be reduced in response to higher operating frequencies. Such reduction in electrical length at higher frequencies can provide improved antenna radiation patterns for the antenna. Further, the electrical length of the bicone antenna may be increased in response to low frequency operation. Such increase in electrical length may improve VSWR performance at lower frequencies. Simultaneous operation of the bicone antenna at varied electrical lengths for varied frequency bands can provide improved broadband performance of the antenna.

19 Claims, 5 Drawing Sheets

FREQUENCY CONTROL OF ELECTRICAL LENGTH FOR BICONE ANTENNAS

RELATED APPLICATION

This patent application claims priority under 35 U.S.C. §119 to U.S. Provisional Patent Application No. 60/899,806, entitled "Low Frequency VSWR Improvement for Bicone Antennas," filed Feb. 6, 2007 and to U.S. Provisional Patent Application No. 60/899,813, entitled "Frequency Control of Electrical Length for Bicone Antennas," filed Feb. 6, 2007. The complete disclosure of the above-identified priority applications is hereby fully incorporated herein by reference.

This patent application is related to the co-assigned U.S. patent application entitled "VSWR Improvement for Bicone Antennas," filed on the same day as the present patent application, and having an unassigned patent application serial number.

FIELD OF THE INVENTION

The present invention relates to an omni-directional broadband bicone antenna and more specifically to a bicone antenna with filter elements for frequency selective control of the electrical length of the antenna.

BACKGROUND

A bicone is generally an antenna having two conical conductors where the conical elements share a common axis and a common vertex. The conical conductors extend in opposite directions. That is, the two flat portions of the cones face outward from one another. The flat portion of the cone can also be thought of as the base of the cone or the opening of the cone. The flat portion, or opening, of a cone is at the opposite end of the cone from the vertex or point of the cone. Bicone antennas are also called biconical antennas. Generally, a bicone antenna is fed from the common vertex. That is, the driving signal is applied to the antenna by a feed line connected at the antenna's central vertex area.

Positioning two cones so that the points (or vertices) of the two cones meet and the openings (or bases) of the two cones extend outward (opposite one another) results in a bowtie-like appearance.

Generally, bicone antennas support a wide bandwidth, but the low end of the operating frequency range is limited by the aperture size of the antenna, which is the overall length of the antenna along the bicone surface. The relationship between aperture size and frequency operation is generally inverse. That is, operation at a lower frequency requires a larger bicone antenna. More specifically, a traditional bicone antenna requires an aperture size of about one half of the longest operating wavelength. The longest wavelength is related to the lowest operating frequency by the wave velocity relationship, "speed of light=wavelength×frequency" where the speed of light is approximately 300,000,000 meters per second.

Lower frequency operation suggests a bicone antenna with an increased electrical length. Increased length often means increased width. This increased electrical length maintains a low VSWR (voltage standing wave ratio) at the lower operating frequencies. This translates into improved matching and thus signal coupling into the antenna. In contrast, higher frequency operation suggests a smaller electrical length. While a bicone antenna with increased electrical length will operate at these higher frequencies, the resulting radiation pattern is generally less effective as more energy is directed upward than out along the horizon.

Accordingly, there is a need in the art for an omni-directional bicone antenna having both a long electrical length for low frequency operation and a reduced electrical length during high frequency operation.

SUMMARY OF THE INVENTION

The present invention comprises a broadband bicone antenna that may support frequency selective control of the electrical length of the antenna. The antenna may also have a reduced aperture size, high input impedance at the central vertex of the cones, and an impedance matching taper to feed the cones.

The frequency selective control of the electrical length of the antenna can allow the antenna to exhibit two or more different electrical lengths where each length depends upon the operating frequencies of the signals. The electrical length of the bicone antenna may be reduced in response to higher operating frequencies. Such reduction in electrical length at higher frequencies can provide improved antenna radiation patterns for the antenna. In contrast, the electrical length of the bicone antenna may be increased in response to low frequency operation. Such increase in electrical length may improve VSWR performance at lower frequencies. Simultaneous operation of the bicone antenna at varied electrical lengths for varied signal frequencies can provide for improved broadband performance of the antenna. That is, the bicone can provide a single aperture antenna with improved performance characteristics at two or more diverse frequency bands.

Filters integrated into the bicone antenna can provide frequency selective control of the electrical length of the bicone antenna. For example, a low-pass filter placed within the bicone may allow lower frequencies to operate along the entire length of the antenna. At the same time, the low-pass filter may block higher frequencies to operate only in the region of the antenna between the feed point and the low-pass filter. Such an antenna may be said to exhibit frequency selective electrical length since the electrical length can change in response to operating frequency even though the physical length of the antenna may remain unchanged.

A view of the level of impedance match for a communications system may be obtained from the system's standing wave ratio (SWR). SWR is the ratio of the amplitude of a partial standing wave at an anti-node (maximum) to the amplitude at an adjacent node (minimum). SWR is usually defined as a voltage ratio called the VSWR, for voltage standing wave ratio. The voltage component of a standing wave in a uniform transmission line consists of the forward wave superimposed on the reflected wave and is therefore a metric of the reflections on the transmission line. Reflections occur as a result of discontinuities, such as an imperfection in an otherwise uniform transmission line, or when a transmission line is terminated with a load impedance other than its characteristic impedance. One aspect of the present invention can improve VSWR performance for lower frequency signals. Such VSWR improvement may result from increased electrical length in response to lower frequency operation, largely via reducing reflected power.

The discussion of bicone antennas with frequency selective control of antenna electrical length presented in this summary is for illustrative purposes only. Various aspects of the present invention may be more clearly understood and appreciated from a review of the following detailed description of the disclosed embodiments and by reference to the drawings and the claims that follow. Moreover, other aspects, systems, methods, features, advantages, and objects of the present invention will become apparent to one with skill in the art upon examination of the following drawings and detailed description. It is intended that all such aspects, systems, methods, features, advantages, and objects are to be included within this description, are to be within the scope of the present invention, and are to be protected by the accompanying claims.

Figure 1:
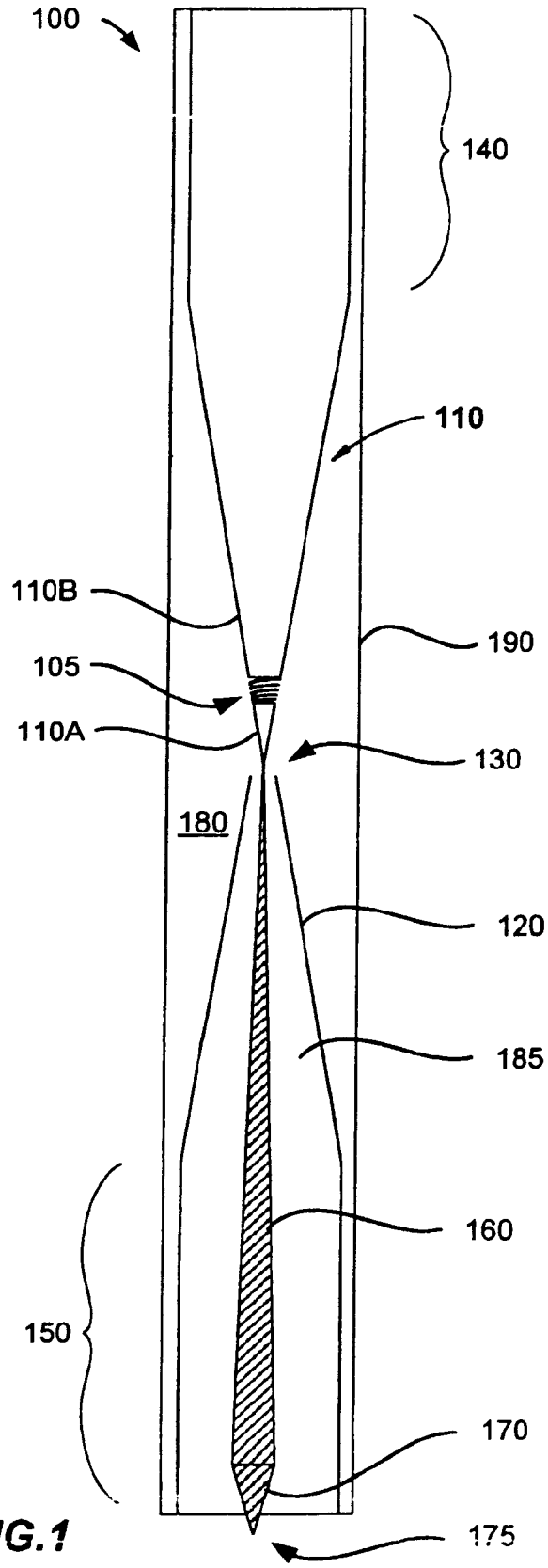
FIG. 1 illustrates a longitudinal bisection of a bicone antenna system with a single filter according to one exemplary embodiment of the present invention.

Many aspects of the invention can be better understood with reference to the above drawings. The elements and features shown in the drawings are not to scale, emphasis instead being placed upon clearly illustrating the principles of exemplary embodiments of the present invention. Moreover, certain dimensions may be exaggerated to help visually convey such principles. In the drawings, reference numerals designate like or corresponding, but not necessarily identical, elements throughout the several views.

DETAILED DESCRIPTION OF EXEMPLARY EMBODIMENTS

The present invention supports the design and operation of a bicone antenna with frequency selective control of the electrical length of the antenna. Such control can allow the antenna to exhibit two or more different electrical lengths where each length depends upon the operating frequencies of the signals. Simultaneous operation of the bicone antenna at varied electrical lengths for varied signal frequencies can provide for improved broadband performance of the antenna. That is, the bicone can provide a single aperture antenna with improved performance characteristics at two or more varied frequency bands.

The bicone antenna may comprise a reduced aperture size achieved by reducing the cone angle. This reduction in cone angle can increase the impedance of the cones thus providing a high impedance bicone antenna system. In recognition of this high impedance characteristic, an impedance matching mechanism can be used to interface with the bicone antenna system. An exemplary impedance matching mechanism is implemented by a flat conductive taper disposed within a cone of the bicone antenna system. This flat conductive taper functions as an impedance matching transmission line between the external feed line to the antenna and the feed point at the vertex of the cones. The single conductive taper, useful for impedance matching, can function as the center conductor of a coaxial feed mechanism. The inside of the bottom cone can serve as the outside conductor (or shielding conductor, or return) of the tapered feed line.

The geometry of the cones may be modified to comprise an end section on one or both of the cones where the end segment is substantially cylindrical. This geometry can support an increase in aperture length without increasing the aperture diameter. The increase in length can support lower frequency operation.

While the antenna system may be referred to as specifically radiating or receiving, one of ordinary skill in the art will appreciate that the invention is widely applicable to both transmitting (exciting a medium) or receiving (be excited by a medium) without departure from the spirit or scope of the invention. Any portion of the description implying a single direction or sense of operation should be considered a non-limiting example. Such an example, that may imply a single sense or direction of operation, should be read to in fact include both directions or senses of operation in full accordance with the principle of electromagnetic reciprocity. In all cases, the antenna may both receive and transmit electromagnetic energy in support of communications applications.

The invention can be embodied in many different forms and should not be construed as limited to the embodiments set forth herein; rather, these embodiments are provided so that this disclosure will be thorough and complete, and will fully convey the scope of the invention to those having ordinary skill in the art. Furthermore, all "examples" or "exemplary embodiments" given herein are intended to be non-limiting, and among others supported by representations of the present invention.

Turning now to FIG. 1, the figure illustrates a longitudinal bisection of a bicone antenna system 100 according to one exemplary embodiment of the present invention. The bicone antenna system 100 comprises an upper cone 110 and a lower cone 120. The upper cone can be separated into a proximal cone portion 110A and a distal cone portion 110B by a filtering element 105. In an exemplary embodiment, the distal cone portion 110B has a geometric form of a truncated cone. The separation and filtering can allow the bicone antenna system 100 to operate as two bicone antennas within a single aperture. For example, with the filtering element 105 functioning substantially as a low-pass filter, higher frequency energy can be substantially confined to the proximal cone portion 110A. In contrast, lower frequency energy may pass the filtering element 105 thus exciting both the proximal cone portion 110A and the distal cone portion 110B. That is, a single antenna system 100 may operate as an antenna with a short electrical length at higher frequencies while also operating as an antenna with a long electrical length at lower frequencies.

The upper cone 110 and the lower cone 120 may each have reduced half-angles. For example, the half-angles of the cones may be less than thirty degrees, even as small as three degrees or smaller. The half-angle of a cone is the angle between the central axis of the cone and any side of the cone. The half-angle of the upper cone 110 may be greater than the half-angle of the lower cone 120. Such a difference may allow for the lower cone 120 to open near the central vertex 130 as illustrated. The half-angle of the upper cone 110 can also be substantially the same as or smaller than the half-angle of the lower cone 120.

This narrowing of the cones 110, 120 may reduce the aperture size of the bicone antenna 100 and also may increase the impedance of the antenna. One exemplary bicone antenna supports an operational bandwidth of 25 MHz to over 6 GHz and is characterized by a diameter of about 2 inches and an overall length of about 44 inches. This means that the height of each cone 110, 120 is about 22 inches. The VSWR over this frequency range can fall between 2:1 and 3:1. This 44-inch long bicone antenna system is considerably smaller than the traditional half wavelength design having a length of 236 inches at 25 MHz. The electrical aperture size can be reduced from the traditional half-wavelength to one-fifth-wavelength or smaller, for example.

To achieve this reduction in size and still maintain the desired VSWR, the bicone characteristic impedance may be increased. With the representative bicone dimensions discussed above, the impedance of the bicone antenna system can be around 306 ohms. This increased impedance characteristic of the bicone antenna system may be mismatched at the signal feed, such as a typical 50 ohm coaxial feed line. This impedance mismatch is addressed in more detail below.

An impedance mismatch between the bicone antenna elements 110, 120 and the feed line connecting to the antenna system 100 can be mitigated by an impedance matching taper 160 provided within the antenna system 100. Generally, a high impedance bicone antenna may have an impedance of about 90 ohms or higher. For example, the exemplary bicone geometry discussed above can exhibit impedances of about 306 ohms. Meanwhile, the most common form of feed line is a 50 ohm coaxial cable, commonly referred to as "coax." The impedance matching taper 160 can connect with the top cone 110 at the central vertex 130 of the antenna system. The impedance matching taper 160 may be welded, soldered, press-fit into or otherwise attached to the upper cone.

At the central vertex 130 of the antenna system 100, the impedance matching taper 160 can be very narrow and may continuously expand towards the bottom of the lower cone 120. Varying the width of the impedance matching taper 160 can control the impedance. Greater widths produce smaller impedances, and smaller widths produce larger impedances, so the width of the impedance matching taper 160 near the high impedance central vertex 130 is narrower than the width of the impedance matching taper 160 near the lower impedance feed line. Other impedance matching structures 160 may be employed. For example, the impedance matching taper 160 may be an exponential taper, a Klopfenstein taper, a continuous taper, or any other type of matching taper. Also, the impedance matching structure 160 may be coax, or other transmission line as well as conical waveguide, circular waveguide, or other waveguide. However, a single strip, continuous taper with uniform thickness may provide a low cost and low complexity solution.

At the bottom, or widest region, of the impedance matching taper 160, a reduction coupler 170 may be provided to reduce the radius of the impedance matching taper 160. The reduction coupler 170 may reduce the radius of the impedance matching taper 160 to allow the application of a connector 175 to the impedance matching taper 160. The connector 175 can provide a connection point between a feed line and the bicone antenna system 100. The connector 175 may be coaxial, N-type, F-type, BNC, waveguide flange, solder terminals, compression fitting, or any other mechanism for connecting a feed line into the antenna system 100.

The impedance matching taper 160 can generally be formed of any conductive material such as copper, aluminum, silver, bronze, brass, any other metal, metallized substrate, or any mixture and/or alloy thereof. The impedance matching taper 160 may be layered, plated, or solid. In one example, the impedance matching taper 160 can be formed from a solid metal part with a rectangular cross-section having a thickness of about 0.025 inches.

While the common 50 ohm coax has been discussed as an example, other types of feed line may be used with the antenna system 100. For example, coax, ladder line, rectangular waveguide, circular waveguide, conical waveguide, or other waveguides and/or cables may be used to feed the bicone antenna system 100. Also, the bicone may be directly fed by a high-impedance transmission line instead of using the impedance matching taper 160.

The volume within the lower cone 120 can contain a dielectric 185. The dielectric 185 can be a foam with a low dielectric constant. The dielectric 185 can provide mechanical support for the impedance matching taper 160. Such mechanical support may operate to position the impedance matching taper 160 in the center of the lower cone 120 in order to maintain the desired impedance. A dielectric 185 with a low dielectric constant may be useful to reduce multi-mode propagation along the impedance matching taper 160 within the lower cone 120. A dielectric 185 with a low dielectric constant may also be useful in supporting higher frequency performance of the antenna system 100. The dielectric 185 may be a polyethylene foam, a polystyrene foam, a foam of some other polymer or plastic, or a solid dielectric. The dielectric 185 may also be a non-continuous structure such as ribs, braces, or trussing that can be formed of plastic, polymer, fiberglass composite, glass, or some other dielectric, for example.

The cones 110, 120 of the antenna system 100 can generally be implemented by any conductive material such as copper, aluminum, silver, bronze, brass, any other metal, metallized substrate, or any mixture and/or alloy thereof. The conductive material of the cones 110/120 may be layered, plated, solid, mesh, wire array, metallized insulator, or foil, as examples.

The cones 110, 120 may be protected from the external environment by a radome 190 that covers or encloses the cones 110, 120. A radome 190 is typically implemented by a structural enclosure useful for protecting an antenna from the external effects of its operating environment. For example, a radome 190 can be used to protect the surfaces of the antenna from the effects of environmental exposure such as wind, rain, sand, sunlight, and/or ice. A radome 190 may also conceal the antenna from public view. The radome 190 is typically transparent to electromagnetic radiation over the operating frequency range of the antenna. The radome 190 can be constructed using various materials such as fiberglass composite, TEFLON coated fabric, plastic, polymers, or any other material or mixture of materials that can maintain the desired level of radio transparency.

The area between the radome 190 and the cones 110, 120 can contain a dielectric 180. The dielectric 180 can be a foam with a low dielectric constant. The dielectric 180 can provide mechanical support for the cones 110, 120. Such mechanical support may operate to position and buffer the cones 110, 120 within the radome 190. A dielectric 180 with a low dielectric constant may be useful in maintaining the high impedance properties of the bicone antenna. The dielectric 180 may be a polyethylene foam, a polystyrene foam, a foam of some other polymer or plastic, or a solid dielectric. The dielectric 180 may also be a non-continuous structure such as ribs, braces, or trussing that can be formed of plastic, polymer, fiberglass composite, glass, or some other dielectric, for example.

While the dielectric 180 and the dielectric 185 may be the same material, they need not be identical in a specific application. For both dielectric 180 and dielectric 185, a low dielectric constant is typically desired. For example, a dielectric constant of less than about two may be used for either dielectric 180 or dielectric 185. One or both of dielectric 180 and dielectric 185 may also be air.

When the central vertex 130 of the antenna system 100 is fed by a single conductor, such as the single strip, impedance matching taper 160, the inside surface of the lower cone 120 may function as the outside conductor, or the return. That is, the conductive taper 160 used for impedance matching can be considered the center conductor of a coaxial feed mechanism where the inside of the lower cone 120 can serve as the outside conductor (or shielding conductor, or return) of the tapered feed 160.

The upper cone 110 can include an extension 140 where the extension may be cylindrical and may have a diameter substantially equal to widest opening of the upper cone 110. The lower cone 120 can include an extension 150 where the extension may be cylindrical and may have a diameter substantially equal to the widest opening of the lower cone 120. Such extensions 140, 150 can support an increase in aperture length without increasing the aperture diameter. This increase in length can support lower frequency operation. In addition to being substantially cylindrical, the extensions 140, 150 may also have a smaller half-angle than the respective cone 110, 120 which it is extending. A cylinder can be considered the limiting case of reducing the half-angle of the radiator.

The addition of a cylindrical or reduced angle extension 140, 150 to a respective cone 110, 120 may be considered forming a cone with two segments of differing angles. Each cone 110, 120 may have 1, 2, 3, 4, 5, or more such segments. That is, each cone 110, 120 may have one or more extensions 140,150. The two cones 110,120 need not have the same number of segments or the same number of extensions 140, 150. The number of extensions 140, 150 to either or both cones 110, 120 may also be zero.

The separation of the upper cone 110 into a proximal cone portion 110A and a distal cone portion 110B can be made at any point within the upper cone 110 or the upper extension 140 that is advantageous to the high frequency operation of the bicone antenna system 100. Such separation and insertion of filter elements 105 may also occur at multiple points along the upper cone 110. These separations may also occur in the lower cone 120 or lower extension 150. Multiple separation and filtering nodes in both the upper cone 110 and the lower cone 120 are discussed in more detail with relation to FIG. 2A. The use of multiple filters at differing lengths may allow the antenna system 100 to have different electrical lengths for two or more frequency bands of operation.

Throughout the discussion of the figures, the conical antenna elements 110, 120 are referred to as the upper cone 110 and the lower cone 120 for consistency. One of ordinary skill in the art will appreciate, however, that the common axis of the conical structures may be vertical, horizontal, or at any desired angle without departing from the scope or spirit of the present invention. That is, the cones may be side-by-side or the upper cone 110 may be positioned below the lower cone 120.

Figure 2A:
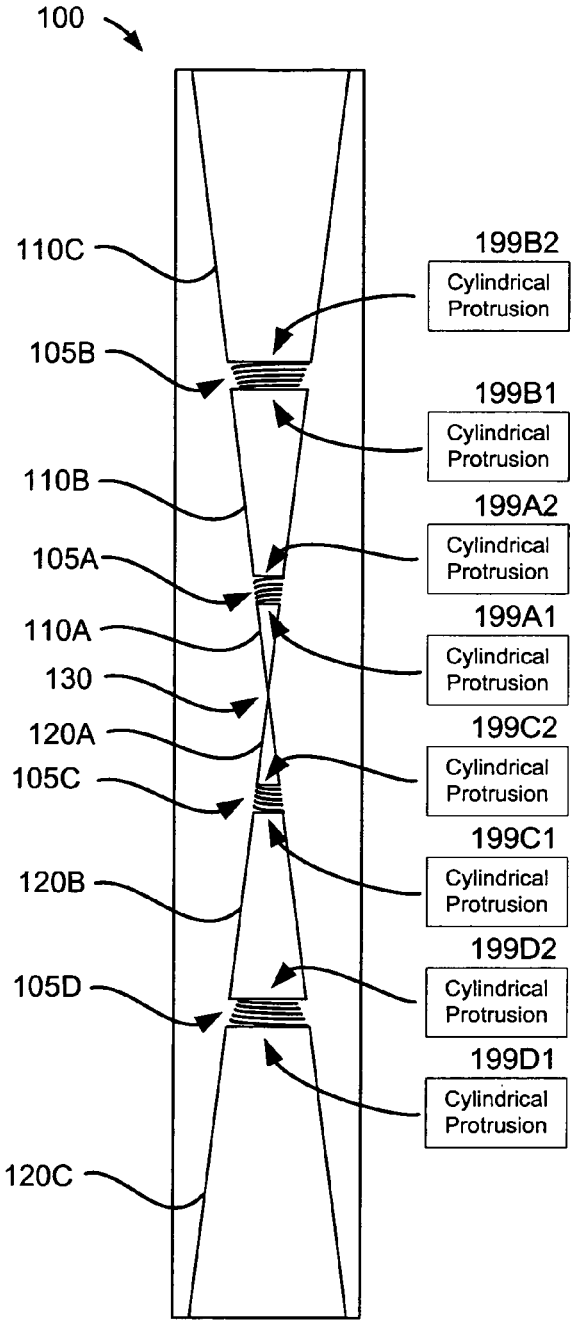
FIG. 2A illustrates an elevation view of a bicone antenna system with four filters according to one exemplary embodiment of the present invention.

Turning now to FIG. 2A, the figure illustrates an elevation view of a bicone antenna system 100 with four filters 105A-105D according to one exemplary embodiment of the present invention. The upper cone 110 may be separated into three portions, a proximal upper cone portion 110A, a middle upper cone portion 110B, and a distal upper cone portion 110C. Similarly, the lower cone 120 may be separated into three portions, a proximal lower cone portion 120A, a middle lower cone portion 120B, and a distal lower cone portion 120C. The bicone antenna 100 can be fed from the center point 130. A feed line (not illustrated) may be connected to the antenna 100 at the center point 130 where the upper and lower cones meet.

A low-pass filter 105A can be used to separate the proximal upper cone portion 110A from the middle upper cone portion 110B. Similarly, a low-pass filter 105C can be used to separate the proximal lower cone portion 120A from the middle lower cone portion 120B. The crossover frequency from the pass band to the stop band of the filter elements 105A and 105C may be selected so that a higher frequency signal is blocked by the filter elements 105A and 105C. This blocking may substantially confine the higher frequency signal to the central region of the antenna 100 comprising the proximal upper cone portion 110A and the proximal lower cone portion 120A. Confining the signal to this central region can reduce the electrical length of the antenna 100 at the higher frequencies.

A low-pass filter 105B can be used to separate the middle upper cone portion 110B from the distal upper cone portion 110C. Similarly, a low-pass filter 105D can be used to separate the middle lower cone portion 120B from the distal lower cone portion 120C. The crossover frequency from the pass band to the stop band of the filter elements 105B and 105D may be at lower frequencies than the crossover frequency of the filter elements 105A and 105C. The crossover frequency from the pass band to the stop band of the filter elements 105B and 105D may be selected so that a mid range frequency signal is blocked by the filter elements 105B and 105D, yet passed by the filter elements 105A and 105C. This filtering may substantially confine the higher frequency signal to the central and middle regions of the antenna 100 comprising the proximal upper cone portion 110A, the middle upper cone portion 110B, the proximal lower cone portion 120A, and the middle lower cone portion 120B. Confining the signal to the central and middle regions can increase the electrical length of the antenna 100 over the electrical length in the high frequency case discussed above, but still maintain an electrical length reduced from the full length of the antenna 100. This could be considered a medium electrical length. Low frequency signals below the crossover point of the filter elements 105B and 105D may not be constrained and instead may excite the entire length of the antenna 100. Operation in these lower frequency bands may imply a longer electrical length than both of the reduced cases discussed above.

The separation of each of the cones 110, 120 into three sections using filter elements 105 may be said to divide the antenna 100 in three separate electrical lengths. The respective electrical lengths may be selected by the frequency of the signals and their relationship to the crossover frequencies of the filter elements 105. These crossover frequencies can be designed to correspond to the desired electrical lengths for the antenna 100 within different bands of operating frequency.

While the example illustrated comprises two filter elements 105 within each cone 110, 120 to separate each cone 110, 120 into three portions, there could be any number of filters placed within the cone 110, 120 to provide various different electrical lengths within the same antenna 100. Additionally, the quantity and placement of the filter elements 105 within the upper cone 110 and within the lower cone 120 may not be identical. There may be more filter elements 105 within the upper cone 110 than in the lower cone 120, or there may be fewer, none, or the same number. The filter elements 105 in the upper cone 110 may be positioned at intervals along the cone 110 that are symmetrical with the placement of the filter elements 105 along the lower cone 120. The positioning of the filter elements 105 within the upper cone 110 may also be asymmetrical with respect to the positioning of the filter elements 105 within the lower cone 120.

The cone portions 110A-C and 120A-C can include one or more substantially cylindrical protrusions 199A1-D2 from the cone portions 110A-C and 120A-C having a thread cut or chased onto it for mating with the filter elements 105A-D. As discussed below with reference to FIG. 2B, one or more end regions of the filter elements 105 may be tightly wound and the interior surface of such an end region may serve as a threaded void for accepting a short threaded shaft or threaded rod. Thus, the filter elements 105 may be mated, by threading, to the cone portions 110A-C and 120A-C. In certain exemplary embodiments, the filter elements 105 comprise a conductive helix mechanically coupled within a partition of a conductive element. In certain exemplary embodiments, the filter elements 105 comprise a conductive helix, and a surface of a conductive element is threaded to mate with an interior surface of the conductive helix.

Figure 2B:
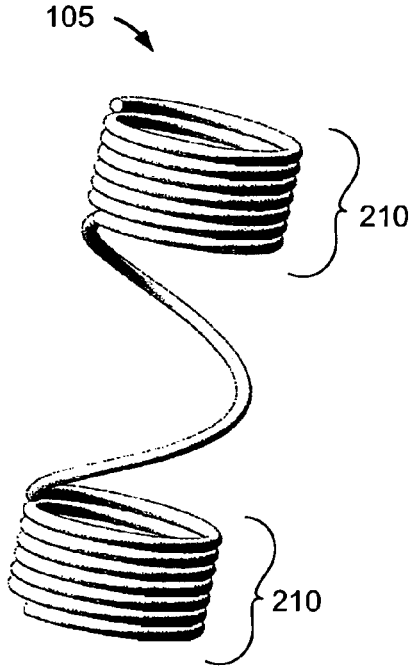
FIG. 2B illustrates a filter element of a bicone antenna system according to one exemplary embodiment of the present invention.

Turning now to FIG. 2B, the figure illustrates a filter element 105 of a bicone antenna system 100 according to one exemplary embodiment of the present invention. The filter element 105 may be an inductive coil or conductive helix. The coil may be formed of a stiff conductor wound into a coil similar to a spring. A spring-like filter element 105 may reduce mechanical rigidity and thus provide increased mechanical robustness to the antenna system 100. One, or more, end regions 210 of the filter element 105 may be tightly wound. The interior surface of such an end region 210 of the filter element 105 may serve as a threaded void for accepting a short threaded shaft or threaded rod. Such threaded coupling may provide an exemplary mating between the filter element 105 and the cone portions that the filter element 105 joins. A substantially cylindrical protrusion from a cone portion may have a thread cut or chased onto it to substantially match the pitch of the coiling within an end region 210 of a filter element 105. Thus, the filter element 105 may be mated, by threading, to the cone portion. Such mating may also be achieved by welding, soldering, bolting, riveting, compression, adhesive, otherwise, or any combination thereof, as non-limiting examples. Additionally, the cone portions and the filter elements 105 may be formed from a singular blank, molding, or casting.

The filter element 105 may operate substantially as an electrical low-pass filter. Other frequency responses (such as high-pass, band-pass, band-stop, linear, non-linear, or any combination thereof) may be provided by the filter element 105 as suitable for the frequency selective electrical length of the bicone antenna system 100. Furthermore, the crossover frequencies of the filters 105 may be sharp or roll off gradually. The filter elements 105 may be inductive, capacitive, lumped, distributed, singular, multiple, in series, in parallel, circuit board, or any combination thereof. The antenna system 100 may comprise multiple filter elements 105 at multiple points along one or both cones 110, 120 and the filters may be the same as one another or different from one another.

Figure 3:
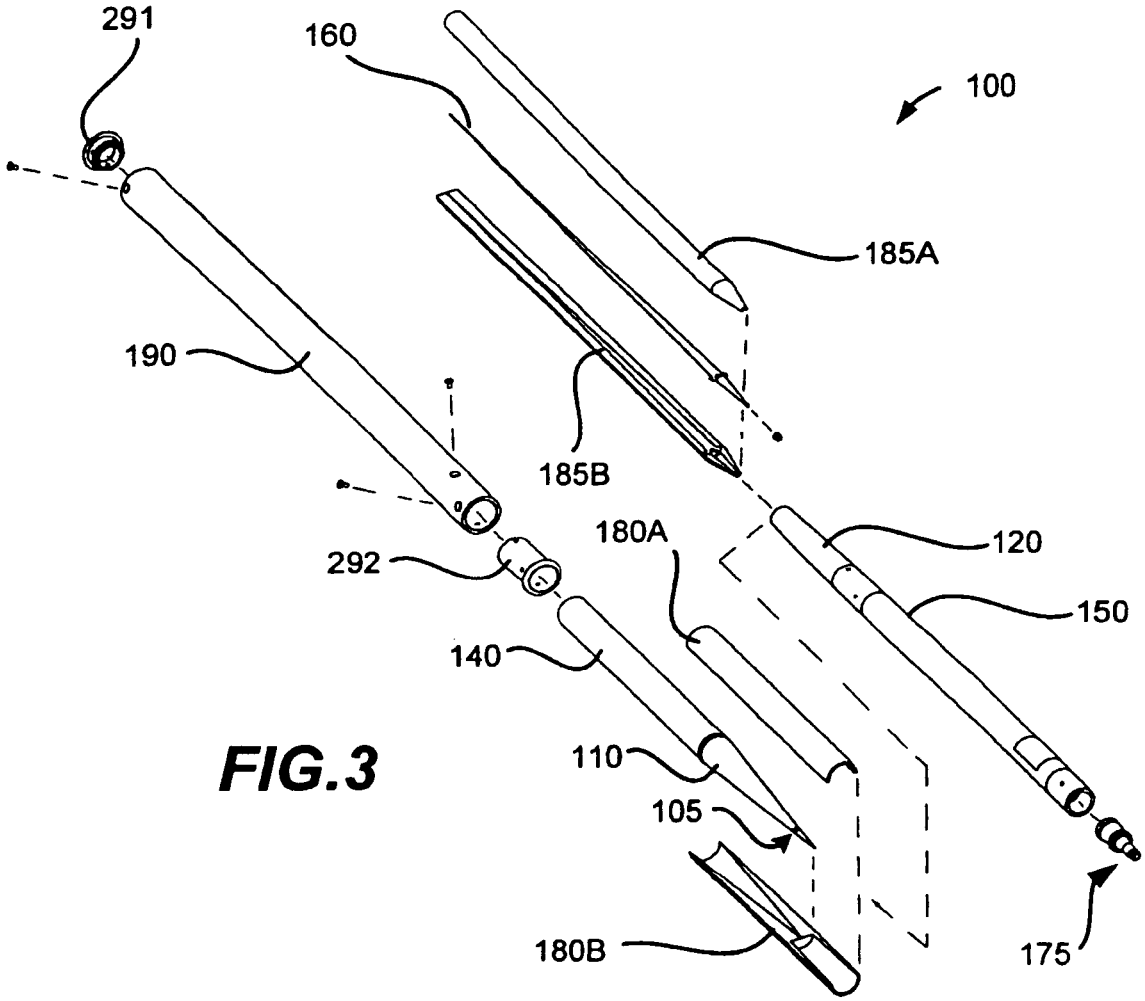
FIG. 3 illustrates an exploded view of a bicone antenna system according to one exemplary embodiment of the present invention.

Turning now to FIG. 3, the figure illustrates an exploded view of a bicone antenna system 100 according to one exemplary embodiment of the present invention. The upper cone 110 may continue into an extension 140. The upper cone 110 may include a filter element 105. Both the upper cone 110 and the lower cone 120 may be formed by molding, casting, stamping, milling, machining, rolling, cutting or any other technique for forming.

The impedance matching taper 160 can be connected at its tip to the tip of the upper cone 110. The impedance matching taper 160 can be supported within the lower cone 120 by a dielectric 185, which FIG. 3 exemplarily illustrates as two halves 185A, 185B (collectively 185).

In one exemplary embodiment, the dielectric 185 can be a series of dielectric ribs. In one exemplary embodiment, the dielectric 185 can be a foam with a low dielectric constant. The foam dielectric 185 can be provided as a single element or as a first half 185A and a second half 185B. The impedance matching taper 160 can be connected at its lower impedance end to a connector 175 for attaching a feed line to the antenna system 100.

A dielectric 180, which FIG. 3 exemplarily illustrates as two halves 180A, 180B (collectively 180), can provide mechanical support around the cones 110, 120. Such mechanical support may operate to position and buffer the cones 110, 120 within a radome 190. The dielectric 180 can be formed of a first half 180A and second half 180B. The dielectric 180 can also be formed by a single element. The dielectric 180 can be a foam that is thermally or chemically set in place around the cones 110, 120. The dielectric 180 can also be molded, machined, or otherwise formed.

As illustrated in FIG. 1, the antenna system 100 may be assembled such that the impedance matching taper 160 and its supporting dielectric 185 are formed into the lower cone 120 and the lower cone extension 150. The connector 175 may be pressed or otherwise attached into the distal end of the lower cone extension 150 in order to electrically communicate with the impedance matching taper 160. The lower cone 120 and the upper cone 110 can come together such that the high impedance end of the impedance matching taper 160 engages with the vertex of the upper cone 110. The combined cones 110, 120; their extension tubes 140, 150; and the surrounding dielectric 180 may then be formed into the radome 190. A coupling collar 292 may be used to mechanically support an interface between the radome 190 and the lower cone extension 150 such that the radome 190 and the lower cone extension 150 become the predominate external elements of the fully assembled system. An end cap 291 may close off the top end of the radome 190. Aspects of the invention supporting these assembly steps may provide for a rugged and robust bicone system 100 that may be efficiently manufactured and assembled to reduce material handing and manufacturing costs.

Figure 4:
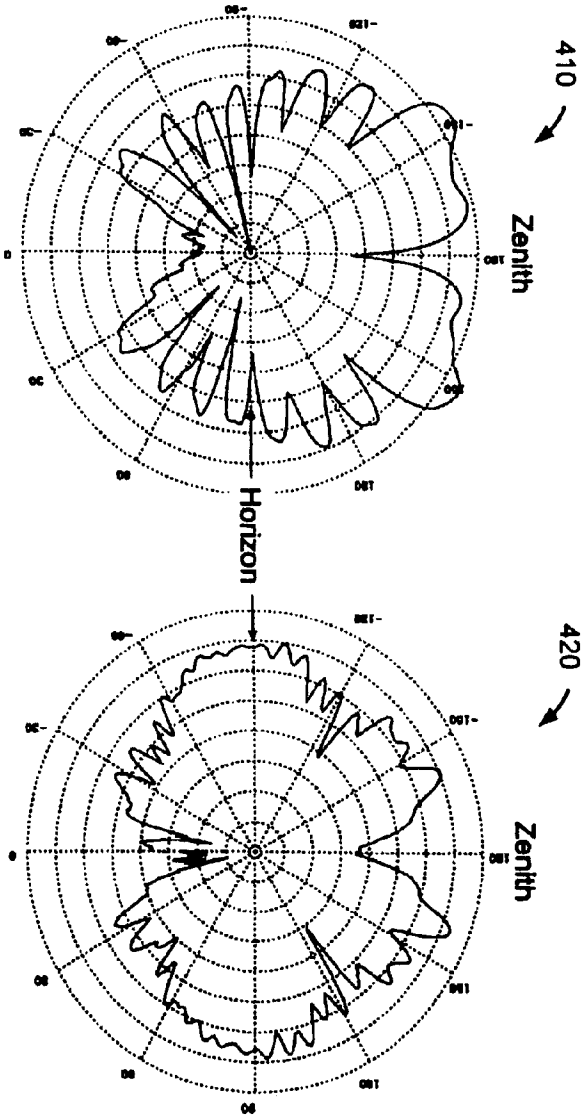
FIG. 4 illustrates antenna radiation patterns of a bicone antenna system with and without filters according to one exemplary embodiment of the present invention.

Turning now to FIG. 4, this figure illustrates antenna radiation patterns of a bicone antenna system 100 both with and without filter elements 105 according to one exemplary embodiment of the present invention. Plot 410 illustrates the radiation pattern without filter elements 105 with high frequency operation. Since the electrical length of the non-filtered antenna system can be longer than ideal for higher frequency operation, undesirable radiation characteristics may result. Increased energy may be radiated upward towards the zenith while nulls in the radiation pattern may develop along the horizon where maximum energy may be desired.

Plot 420 illustrates the radiation pattern with the filters in place. With filter elements 105 in place, the electrical length of the antenna system 100 may be reduced for high frequency operation. This reduced electrical length may be beneficial to prevent excessive energy from radiating skyward toward the zenith and can also substantially reduce the nulls near the horizon.

Figure 5:
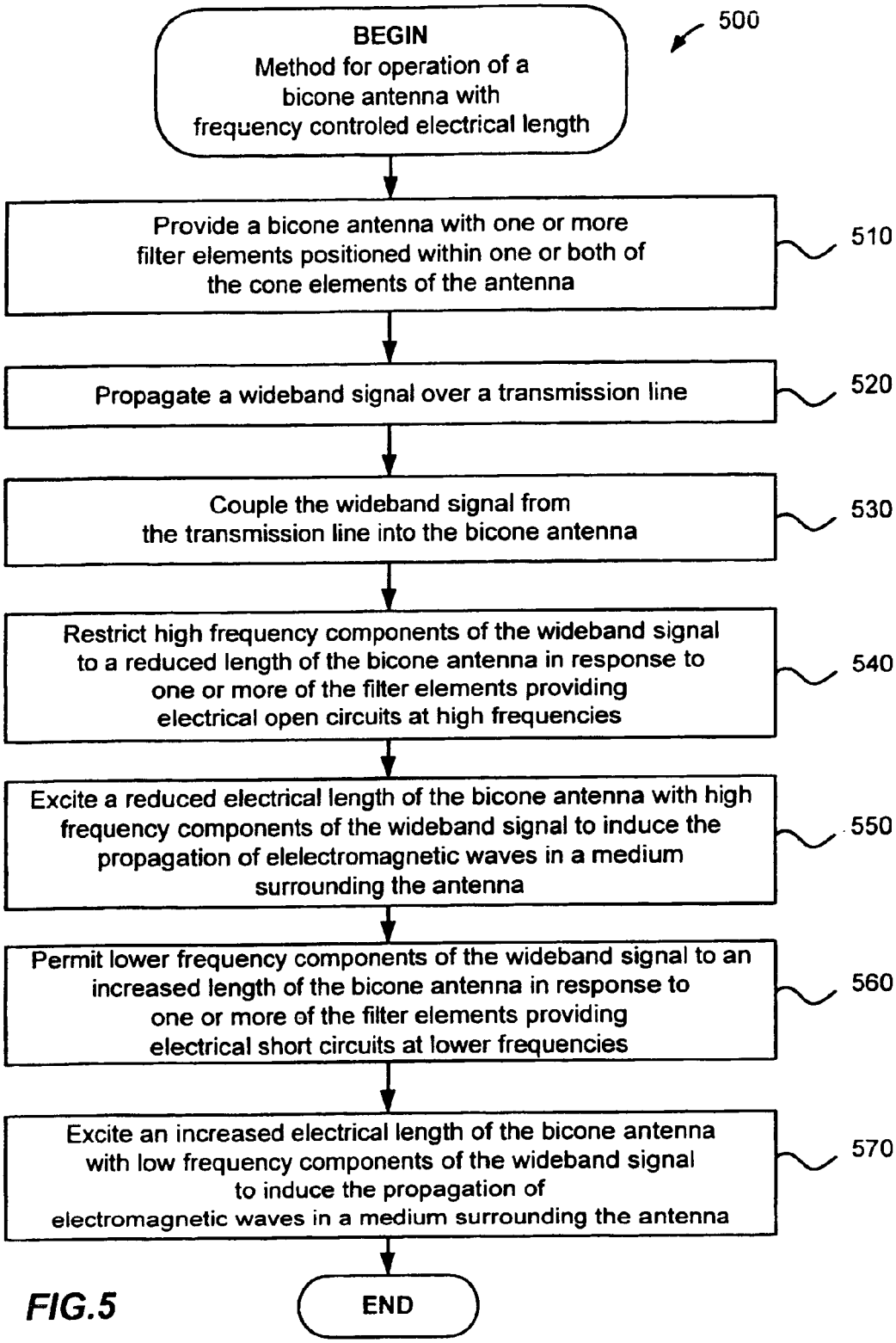
FIG. 5 is a logical flow diagram of a process for operating a bicone antenna with frequency controlled electrical length according to one exemplary embodiment of the present invention.

Turning now to FIG. 5, the figure shows a logical flow diagram 500 of a process for operating a bicone antenna 100 with frequency controlled electrical length according to one exemplary embodiment of the present invention. Certain steps in the processes or process flow described in the logic flow diagram referred to below must naturally precede others for the invention to function as described. However, the invention is not limited to the order of the steps described if such order or sequence does not alter the functionality of the invention. That is, it is recognized that some steps may be performed before, after, or in parallel with other steps without departing from the scope or spirit of the invention.

In Step 510, a bicone antenna is provided for a communications application, i.e., transmission and/or reception of electromagnetic signals. The bicone antenna 100 may comprise one or more filter elements 105 positioned within one or both of the cone elements of the antenna 100. The filter elements 105 may be low-pass filters, inductors, coils, or any other type of filter.

In Step 520, a wideband signal can be propagated over a transmission line.

In Step 530, the wideband signal can be coupled from the transmission line into the bicone antenna 100. The signal may be coupled into a low impedance end of an impedance matching taper 160. The signal coupling may employ a connector 175. The impedance matching taper 160 may also be any other mechanism for impedance matching, such as a transformer. The coupling may also be directly to the cone elements without the use of taper 160.

In Step 540, high frequency components of the wideband signal can be restricted to a reduced length of the bicone antenna. This restriction can be in response to one or more of the filter elements providing electrical open-circuits at high frequencies. For example, a low-pass filter can act as an open-circuit, or a high resistance, high reactance, or other high attenuation with respect to high frequency signals.

In Step 550, the reduced electrical length of the bicone antenna for high frequency operation can be electrically excited by the high frequency components of the wideband signal. Such electrical excitement can induce the propagation of electromagnetic waves from the antenna 100 in a medium surrounding the antenna 100.

In Step 560, low frequency components of the wideband signal can be permitted to an increased length of the bicone antenna. This propagation can be in response to one or more of the filter elements providing electrical short-circuits at low frequencies. For example, a low-pass filter can act as a short-circuit, or a low resistance, low reactance, or other low attenuation with respect to low frequency signals.

In Step 570, an increased electrical length of the bicone antenna can be excited with low frequency components of the wideband signal. Such electrical excitement can induce the propagation of electromagnetic waves from the antenna 100 in a medium surrounding the antenna 100. The exemplary process 500, while possibly operated continuously, may be considered complete after Step 570.

Although the process 500 is described above with one or more filter elements 105 providing two diverse electrical lengths for the bicone antenna 100, additional filter elements 105 may be similarly employed to provide more than two diverse electrical lengths within a single antenna 100. One example may include N filter elements 105 within either or both cones to provide N+1 diverse electrical lengths. Such an arrangement of N+1 electrical lengths may improve performance for each of N+1 different bands of operating frequencies.

Although the process 500 is described above in connection with the radiation or transmission of an electromagnetic signal, the process 500 may also be operated in reverse due to electromagnetic reciprocity. Such reverse operation of process 500 may be considered signal reception where the antenna 100 operates as a receiving antenna that is excited by the surrounding medium instead of exciting the surrounding medium.

From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is to be limited only by the claims that follow.

What is claimed is:

1. An antenna system comprising:

a first conductive element comprising a first substantially conical geometry;

a second conductive element comprising a second substantially conical geometry and positioned on a common axis with the first conductive element to form a first bicone antenna comprising a first length along the common axis;

a filter element disposed at a distal end of the first conductive element and in electrical communication with the first conductive element; and a third conductive element comprising a truncated-cone geometry and positioned on the common axis distal to the filter element and in electrical communication with the filter element, wherein the first conductive element, the second conductive element, the filter element, and the third conductive element form a second bicone antenna comprising a second length along the common axis.

2. The antenna system of claim 1, wherein the filter element is operable to substantially restrict a high frequency signal to the first bicone antenna and operable to substantially conduct a low frequency signal to the second bicone antenna.

3. The antenna system of claim 1, wherein a transition frequency of the filter element is operable to restrict a frequency range of signals to the first bicone antenna in response to the frequency range being substantially tuned to the first length.

4. The antenna system of claim 1, wherein a transition frequency of the filter element is operable to substantially conduct a frequency range of signals to the second bicone antenna in response to the frequency range being substantially tuned to the second length.

5. The antenna system of claim 1, wherein the filter element comprises a low-pass filter.

6. The antenna system of claim 1, wherein the filter element comprises an inductor.

7. The antenna system of claim 1, wherein the filter element comprises a coil.

8. The antenna system of claim 1, wherein the filter element comprises a conductive helix mechanically coupled within a partition of the first conductive element.

9. The antenna system of claim 1, wherein the filter element comprises a conductive helix, and a surface of the first conductive element is threaded to mate with an interior surface of the conductive helix.

10. The antenna system of claim 1, further comprising a secondary filter element disposed distal to the third conductive element, and a fourth conductive element positioned distal to the secondary filter element along the common axis; wherein the first conductive element, the second conductive element, the third conductive element, the fourth conductive element, the filter element, and the secondary filter element form a third bicone antenna comprising a third length along the common axis.

11. An antenna system comprising:

a first conductive cone element;

a second conductive cone element positioned on a common axis with the first conductive cone element to form a bicone antenna comprising a first length along the common axis; and one or more filter elements, each comprising a low pass filter, disposed along the first length and subdividing the bicone antenna into one or more reduced length bicone antennas having electrical lengths less than the first length.

12. The antenna system of claim 11, wherein one or more filter elements are operable to restrict ranges of frequencies to respective reduced length bicone antennas in response to the reduced length bicone antennas comprising respective lengths tuned to the respective ranges of frequencies.

13. The antenna system of claim 11, wherein each of the one or more filter elements comprises an inductor.

14. The antenna system of claim 11, wherein each of the one or more filter elements comprises a coil.

15. The antenna system of claim 11, wherein each of the one or more filter elements comprises a conductive helical element.

16. A method for operating a bicone antenna with frequency controlled electrical length comprising the steps of:

providing the bicone antenna with a filter element positioned within conductive cone elements of the bicone antenna;

restricting a high frequency range of a wideband signal to a reduced length of the bicone antenna in response to the filter element providing a substantially open circuit at high frequencies;

exciting the reduced length of the bicone antenna with the high frequency range of the wideband signal to induce propagation of electromagnetic waves in a medium surrounding the antenna;

permitting a low frequency range of the wideband signal to excite an increased length of the bicone antenna in response to the filter element providing a substantially closed circuit at lower frequencies;

exciting the increased length of the bicone antenna with the low frequency range of the wideband signal to induce propagation of electromagnetic waves in a medium surrounding the antenna; and dynamically selecting an electrical length for operating the bicone antenna in response to a frequency range of the wideband signal and a frequency response of the filter element.

17. The method of claim 16, further comprising the step of coupling the wideband signal from a transmission line into the bicone antenna.

18. The method of claim 16, further comprising the step of providing multiple filter elements to mechanically subdivide the bicone antenna into multiple reduced lengths while electrically isolating multiple frequency ranges to respective reduced lengths.

19. An antenna system comprising:

a conductive cone element comprising:

a first section comprising a base and a point and having a conical form; and a second section comprising a first end and a second end and having a truncated conical form that tapers down from the first end to the second end; and a filter element disposed between the first section and the second section and adjacent the base and the second end, comprising a conductive helix in electrical contact with the base and the second end.

* * * * *